United States Patent [19]

Langenhorst

[11] 4,439,965

[45] Apr. 3, 1984

[54] FIRECODE DOOR-CASING ELEMENT

[75] Inventor: Günter Langenhorst, Bad Sassendorf, Fed. Rep. of Germany

[73] Assignee: top-element Bauelemente für Innenausbau + Raumgestaltung GmbH & Co. KG, Hamm, Fed. Rep. of Germany

[21] Appl. No.: 340,798

[22] Filed: Jan. 19, 1982

[30] Foreign Application Priority Data

Jan. 20, 1981 [DE] Fed. Rep. of Germany ..... 3101551

[51] Int. Cl.[3] ..... E06B 1/12

[52] U.S. Cl. ..... 52/211

[58] Field of Search ..... 52/211; 49/DIG. 1, 505, 49/504

[56] References Cited

U.S. PATENT DOCUMENTS

| | | | |
|---|---|---|---|
| 3,324,599 | 6/1967 | Brost | 49/505 |
| 3,420,026 | 1/1969 | Nolan | 49/DIG. 1 |
| 3,654,734 | 4/1972 | Lehman | 49/505 |
| 3,812,621 | 5/1974 | Ragland | 49/505 |
| 4,250,673 | 2/1981 | Hubbard | 52/211 |

FOREIGN PATENT DOCUMENTS

| | | | |
|---|---|---|---|
| 1509258 | 12/1968 | Fed. Rep. of Germany | 49/505 |
| 408375 | 9/1966 | Switzerland | 49/505 |

*Primary Examiner*—J. Karl Bell

*Attorney, Agent, or Firm*—Karl F. Ross; Herbert Dubno

[57] ABSTRACT

A door-casing element comprises an elongated inner metallic profile, an elongated outer metallic profile parallel to and spaced outwardly from the inner profile, an elongated thermally relatively nonconductive connector between and engaging both of the profiles, and ratchet formations securing the profiles in spaced-apart relationship to the connector. The inner and outer profiles are spaced so it is possible to form them of aluminum, which can be made with an attractive anodized finish and which can be used in outdoors applications without danger of rust. The thermally nonconductive connector, which can be made of rigid and fire-resistant gypsum fibers, will not transmit heat effectively between the two profiles so that the resultant casing can easily be of high firecode rating.

9 Claims, 3 Drawing Figures

FIRECODE DOOR-CASING ELEMENT

FIELD OF THE INVENTION

The present invention relates to a door casing of the firecode or fire-resistant type. More particularly this invention concerns such an element which is largely metallic and which can be adjusted for different wall thicknesses.

BACKGROUND OF THE INVENTION

A standard adjustable firecode door casing is formed by a pair of upright side elements and a horizontal lintel element bridging the side elements, the elements each in turned being formed by an inner and an outer profile. The inner profile is formed with the doorstop. The two profiles have flanges that are directed toward each other and the flange of the inner profile is normally of U-section so that the outer-profile flange can slip into it. Bolts engaged between the two profiles secure them together to either side of the wall edge they are mounted on.

One of the problems with such door-casing elements is that they have only a limited degree of adjustability, normally at most one inch. Thus the builder must buy that door frame whose range covers the wall thickness in question, which often leads to having to buy several different sizes of frames in order, for instance, to compensate for the thicker walls of lower stories.

In addition it is essential in firecode construction that the profiles be made of steel. Aluminum would be preferred, since it does not rust, is lighter, and can be produced with attractive hard finishes, but aluminum is a better conductor of heat so that it softens much sooner than steel would. In fact it is impossible to make a so-called one-hour door casing, that is a casing which will hold out fire for one hour, of aluminum with known technology. What is more the complex profiles needed can be produced relatively easily by extrusion in aluminum, but can only be made in steel with expensive high-technology equipment.

OBJECTS OF THE INVENTION

It is therefore an object of the present invention to provide an improved door-casing element.

Another object is the provision of such a door-casing element which overcomes the above-given disadvantages.

A further object is to provide a firecode door-casing element made principally of aluminum.

SUMMARY OF THE INVENTION

These objects are attained according to the instant invention in a door-casing element comprising an elongated inner metallic profile, an elongated outer metallic profile parallel to and spaced outwardly from the inner profile, an elongated thermally relatively nonconductive connector between and engaging both of the profiles, and means securing the profiles in spaced-apart relationship to the connector.

Thus in the system according to this invention the inner and outer profiles are spaced apart. This makes it possible to form them of aluminum, which can be made with an attractive anodized finish and which can be used in outdoors applications without danger of rust. The thermally nonconductive connector, which according to this invention can be made of rigid and fire-resistant gypsum fibers, will not transmit heat effectively between the two profiles so that the resultant casing can easily be of heavy duty Class B rating, that is one and one-half hour fire rating.

According to further features of this invention the profiles have respective flanges projecting toward each other and having spaced edges. These flanges lie on the connector. Such construction allows the profiles to have relatively simple shapes which are cheap to manufacture, while resisting the type of deformation—spreading of the sides of the U-section flange—to which the prior-art arrangements were subject.

According to another feature of this invention the connector is formed with recesses open toward the profiles. The profiles have tongues constituting the means and engaged in the recesses. More particularly the means includes elastic latching tabs on the connector in the recesses and ratchet formations on the tongues lockingly engageable with the respective tabs. The interaction of the latching tabs and ratchet formations permits one-way relative displacement of the profiles and connector, so they can be pushed together but not pulled apart. The connector is tightly gripped by the profiles, between their flanges and these tongues, to form a compact and sturdy assembly. Thus it is possible to simply push the two flanges against opposite longitudinal sides of the connector to lock the entire assembly together, gripping the door-opening edge. It is also possible to permanently secure one of the profiles to the connector, so that the other profile is then ratcheted into the assembly formed by the one profile and the connector fixed to it.

The edges define a gap. According to this invention a cover strip fills this gap and covers the connector between the edges. Thus the builder need merely nail up the connector, ratchet the two profiles to it, and then cover up the exposed part of the connector, and the visible nail heads, with a matching trim strip that lies flush with the flanges it is between.

A door casing produced using the elements of the instant invention as the side pieces and lintel can be made to satisfy all normal firecodes. At the same time it can be made relatively cheaply and can have all the advantages of aluminum construction. The door casing can have a relatively wide degree of adjustability so that it can fit virtually any normal wall thickness.

DESCRIPTION OF THE DRAWING

The above and other features and advantages will become more readily apparent from the following, reference being made to the accompanying drawing in which.

SPECIFIC DESCRIPTION

Figure 1:
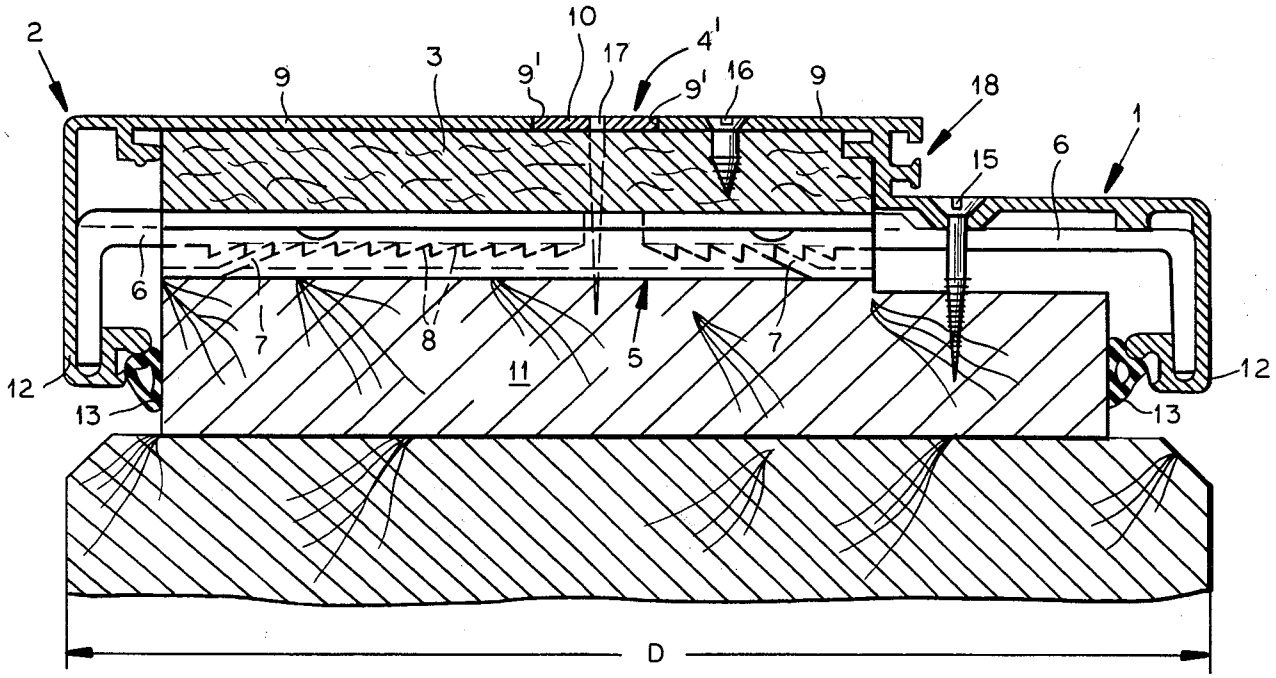
FIG. 1 is a cross section through a door-casing element according to this invention mounted on a door-opening edge.
Figure 2:
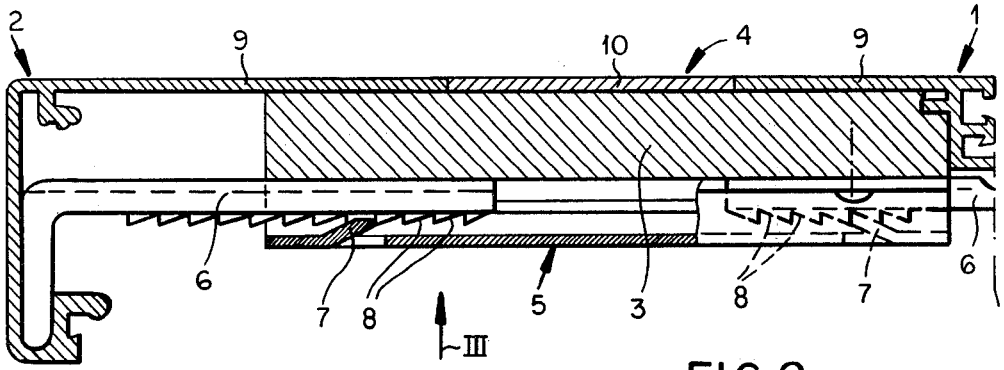
FIG. 2 is a large-scale view of a detail of FIG. 1.
Figure 3:
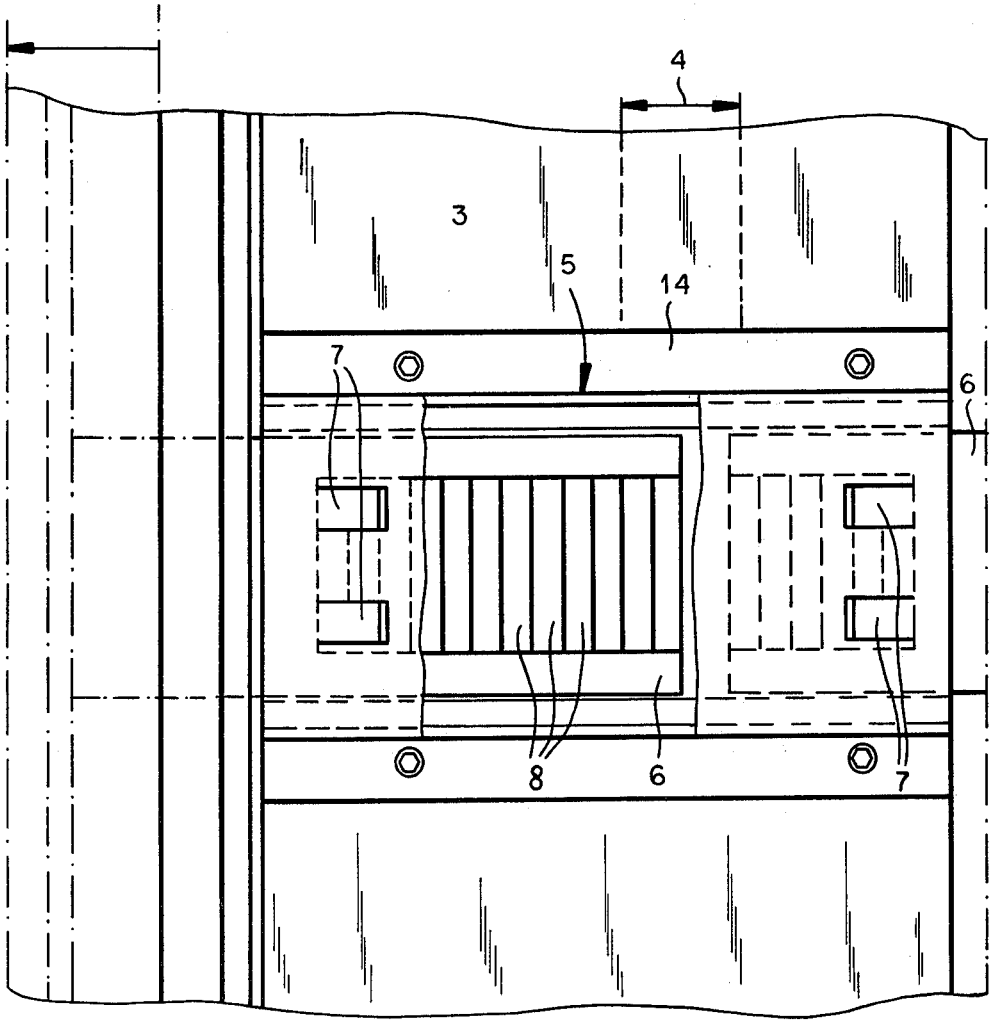
FIG. 3 is a partly sectional bottom view taken in the direction of arrow III of FIG. 2.

An inner profile 1 and an outer profile 2 as seen in FIG. 1 embrace a board 11 at the edge of a door opening. These profiles 1 and 2 are aluminum extrusions and have coplanar and flat inner flanges 9 and generally parallel outer flanges 12, with seals 13 engaged between the outer edges of the outer flanges 12 and the filler board 11. A connector board 3 extending parallel to the two profiles 1 and 2 is engaged flatly by the two flanges 9 whose juxtaposed edges 9' are separated by a longitudinally extending notch or gap 4 having a depth equal to the thickness of the flanges 9 and a width equal to the distance between the normally parallel edges 9'. The door-casing element of FIG. 1 is shown in its condition of minimal depth D, that is when it is of the smallest possible depth. In fact it can be gripped to a much deeper opening, in which case there will be substantial space between the longitudinal edges of the connector 3 and the parts of the profiles 1 and 2 it is now butting, and with the gap 4 correspondingly wider.

The connector 3 is formed at regular intervals along its length with transversely open recesses or grooves 5 into which L-shaped ratchet elements 6 carried by the profiles 1 and 2 can fit. Projecting down into each of these grooves 5 is a pair of tabs 7 formed on a steel plate 14 screwed to the connector board 3 over each groove 5. In addition the ratchet elements 4 are each formed with sawtooth ratchet formations or teeth 8 that cooperate ratchet-fashion with the tabs 7 to allow the elements to slide into the grooves 5, deflecting the tabs 7 outwardly. These tabs 7 ratchet in behind the teeth 8 to prevent the elements 6 from pulling out of the grooves 5.

It is possible for screws 15 to secure the profile 1 permanently to the filler board 11, or for screws 16 to secure this profile 1 to the connector board 3. In addition the gap 4 can be covered by a strip 10 having the same thickness as the flanges 9 and that is secured to the connector 3 by screws after securing the connector 3 with nails 17 to the door filler board 11 if necessary.

A door casing according to this invention is normally mounted in place by first truing the connector board 3 to the vertical and then centrally securing it to the filler board 11 with nails 17. The inside profile 1 is then hammered into the connector 3, with its elements 6 ratcheting with the tabs 7, and it is also secured by screws 15 to the door-edge board 11. These screws 15 spare the nails 17 from the considerable force of the door that closes against the stop 18 formed by the inside profile 1. The outside profile 2 is then similarly ratcheted into the other side of the connector 3. This profile 2 needs no additional securing, as it serves merely as trim, having no structural task.

Alternately it is possible to have the profile 1 secured to the connector board 3 with screws 16 and to dispense with the ratchet elements 6 on the profile 1. In this case the assembly formed by the profile 1 secured by the screws 16 to the connector board 3 is trued to the vertical and nailed and/or screwed to the door-edge board 11. The outer profile 2 is then slipped in and the installation is complete.

Either way the system according to the invention is enormously simple. It can be installed extremely easily and can have a high degree of adjustability, equal to twice the length of the toothed regions on the elements 6, which can be equal to several inches. As aluminum can be used for the profiles 1, it is possible to form them by extrusion with cross sections of considerable intricacy, and one can use anodized colors that will have a long service life. The gypsum connector board 3 will prevent conduction of substantial heat between the profiles 1 and 2, and itself is fireproof.

I claim:

1. A door-casing element comprising:

an elongated inner metallic profile;

an elongated outer metallic profile parallel to and spaced outward from said inner profile;

an elongated thermally relatively nonconductive connector between and engaging both of said profiles, said connector being formed with recesses open toward said profiles; and means including respective tongues projecting transversely from said profiles and engaged in said recesses for securing said profiles in spaced-apart relationship to said connector with each of said profiles being securable to said connector at any of a plurality of transversely offset positions.

2. The casing element defined in claim 1 wherein said profiles have respective flanges projecting toward each other and having spaced edges, said flanges lying on said connector.

3. The casing element defined in claim 2 wherein said connector is rigid and highly fire resistant.

4. The casing element defined in claim 1 wherein said means includes elastic latching tabs on said connector in said recesses and ratchet formations on said tongues lockingly engageable with the respective tabs.

5. The casing element defined in claim 2, further comprising means permanently securing one of said profiles permanently to said connector.

6. The casing element defined in claim 2 wherein said edges define a gap, said element comprising a cover strip filling said gap and covering said connector between said edges.

7. The casing element defined in claim 6 wherein said cover strip is flush with said flanges.

8. The casing element defined in claim 1 wherein said profiles are of aluminum.

9. The casing element defined in claim 1 wherein said connector is of gypsum.

* * * * *